US006683403B2

(12) United States Patent
Baek

(10) Patent No.: US 6,683,403 B2
(45) Date of Patent: Jan. 27, 2004

(54) PANEL FOR FLAT SCREEN TYPE CRT

(75) Inventor: Jae Seung Baek, Busan (KR)

(73) Assignee: LG Electronics, Inc., Seoul (KR)

( * ) Notice: Subject to any disclaimer, the term of this patent is extended or adjusted under 35 U.S.C. 154(b) by 136 days.

(21) Appl. No.: 09/983,267

(22) Filed: Oct. 23, 2001

(65) Prior Publication Data

US 2002/0084741 A1 Jul. 4, 2002

(30) Foreign Application Priority Data

Dec. 29, 2000 (KR) ..... 2000/86359

(51) Int. Cl.[7] ..... H01J 29/18
(52) U.S. Cl. ..... 313/461; 313/477 R
(58) Field of Search ..... 313/461–466, 313/477 R, 478, 408; 220/2.1 A; 428/14

(56) References Cited

U.S. PATENT DOCUMENTS 4,943,754 A * 7/1990 Hirai et al. ..... 313/477 R
5,107,999 A * 4/1992 Canevazzi ..... 220/2.1 A
5,386,174 A * 1/1995 Ishii ..... 313/408

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

A panel for a flat screen type CRT includes an internal curvature portion wherein a screen effective surface is formed, and a skirt portion extended rearwardly from an edge of the internal curvature portion. Where Rs is the radius of curvature at an inner side of a corner of a seal edge portion in the skirt portion and Rx, Ry, and Rd are respectively the radii of blend curvature of a long-side portion, a short-side portion and a corner portion in a part where the internal curvature portion and skirt portion meet, the relations $0.4<Rd/Rs<0.6$, $1 \leqq Rx/Rd \leqq 4$, and $1 \leqq Ry/Rd \leqq 2$ are satisfied, whereby the size of the screen effective surface area can be increased compared to that of a CRT of the same size.

11 Claims, 5 Drawing Sheets

PANEL FOR FLAT SCREEN TYPE CRT

BACKGROUND OF THE INVENTION

1. Field of the Invention

The present invention relates to a flat screen type color Cathode Ray Tube (hereinafter, CRT), and particularly, a panel for a flat screen type color CRT coupled at a front portion of a funnel, for reproducing a color image.

2. Description of the Background Art

Generally, a flat screen color CRT, as shown in FIG. 1, includes a panel 1, funnel 2 and an electron gun 3.

A fluorescent layer 4 made of fluorescent material in the form of red, green and blue stripes or dots is formed on an inner surface of the panel 1, and a shadow mask 5 which functions as a color selection electrode is positioned at the rear side of the fluorescent layer 4.

A funnel 2, a vacuum bulb, is connected at the rear side of the panel 1, and at a neck portion of the funnel 2, an electron gun 3 is mounted for scanning electron beams B. A deflection yoke 6 is installed on the circumferential surface of the neck portion.

A main frame 7 made of metallic material in a rectangular form connecting the panel 1 and a shadow mask 5, and a spring 8 are installed inside the panel 1 and the funnel 2, and an inner shield 9 is fixed to the main frame 7 to shield against the influence of external magnetic fields.

The flat screen CRT displays a picture image when the electron beams B, are deflected in the horizontal and vertical directions by the magnetic fields of the deflection yoke 6, and impinge upon the fluorescent layer 4 formed inside the panel 1, emitting fluorescent light.

In the flat screen CRT, wherein the internal parts are constructed to maintain a high-degree vacuum, and as the flat screen CRT can be damaged easily by external impact, the panel 1 is designed to have a sufficient strength capable of withstanding atmospheric pressure and external impact.

Also, the flat screen CRT is provided with a reinforcing band formed on the circumferential surface of the skirt portion of the panel 1, and accordingly, the flat screen CRT is constructed to have a sufficient impact resistance by dispersing stress received by the CRT under a high-degree vacuum.

A conventional flat screen CRT is made by joining the parts of the bulb composed of the panel 1 and the funnel 2 through an exhausting process after installing the electron gun 3 at the neck portion of the funnel 2.

At this time, the panel 1 and the funnel 2 are put under considerable tension and compressive force as the interior volume is evacuated during manufacturing. Accordingly, in case an excessive tension stress is generated in a certain location of the panel 1, and an impact occurs at a portion undergoing excessive tension stress, there is a problem as the risk of the CRT imploding is increased, Particularly, as current flat screen CRTs become large-sized, the inner and outer surfaces of the panel 1 are being made more flattened, as a result of the flattening tendency of the inner or outer surfaces of the panel 1, the implosion proof characteristic of the panel 1 is relatively weakened.

Therefore, to sufficiently maintain the implosion proof characteristic of the panel 1, the panel 1 should be made thick. However, there is a problem in that the luminance is decreased thereby and to increase the luminance, the thickness of the fluorescent material on the inside should be increased if the panel 1 is made thicker in a screen effective area.

Also, to increase the thickness of the fluorescent layer, in the limited effective surface area, a black matrix BM separating the portions of fluorescent material is formed to have a narrow width, causing a problem of deteriorated color purity.

SUMMARY OF THE INVENTION

An object of the present invention is to provide a panel for a flat screen type CRT capable of reducing the risk of damage during in the heating process in manufacture by increasing the size of the screen effective surface in accordance with the increasing of the degree of vacuum of the panel, which overcomes the problems encountered in the conventional panel for a flat screen type CRT.

To achieve the above object, the panel for a flat screen type CRT in accordance with the present invention includes an internal curvature portion within which a screen effective surface area is formed, and a skirt portion, for being connected to a funnel being extended rearwardly from the edge of the internal curvature portion; and wherein, when a radius of curvature at the inner side of the corner from the skirt portion to a sealing edge portion therein is Rs, and the radii of blend curvature of a long-side portion, a short-side portion, and a corner portion in the part where the internal curvature portion and skirt portion meet are Rx, Ry, and Rd respectively, the equations of $0.4<Rd/Rs<0.6$, $1\leqq Rx/Rd\leqq 4$, and $1\leqq Ry/Rd\leqq 2$ are satisfied.

DETAILED DESCRIPTION OF THE PREFERRED EMBODIMENTS

Hereinafter, the panel for a flat screen CRT in accordance with the present invention will be described with reference to the accompanying drawings.

A number of embodiments of the panel for a flat screen CRT in accordance with the present invention are possible, but hereinafter the more preferred embodiments will be described.

Figure 1:
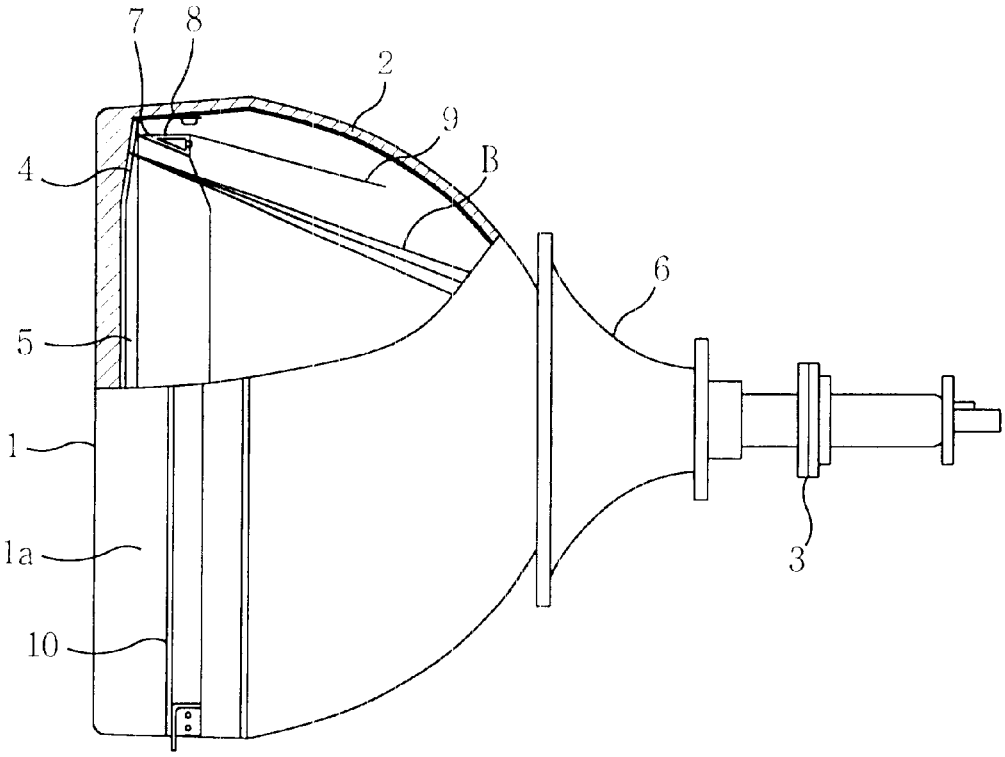
FIG. 1 BACKGROUND ART
FIG. 1 is a sectional view showing the general construction of a conventional flat screen type CRT.
Figure 2:
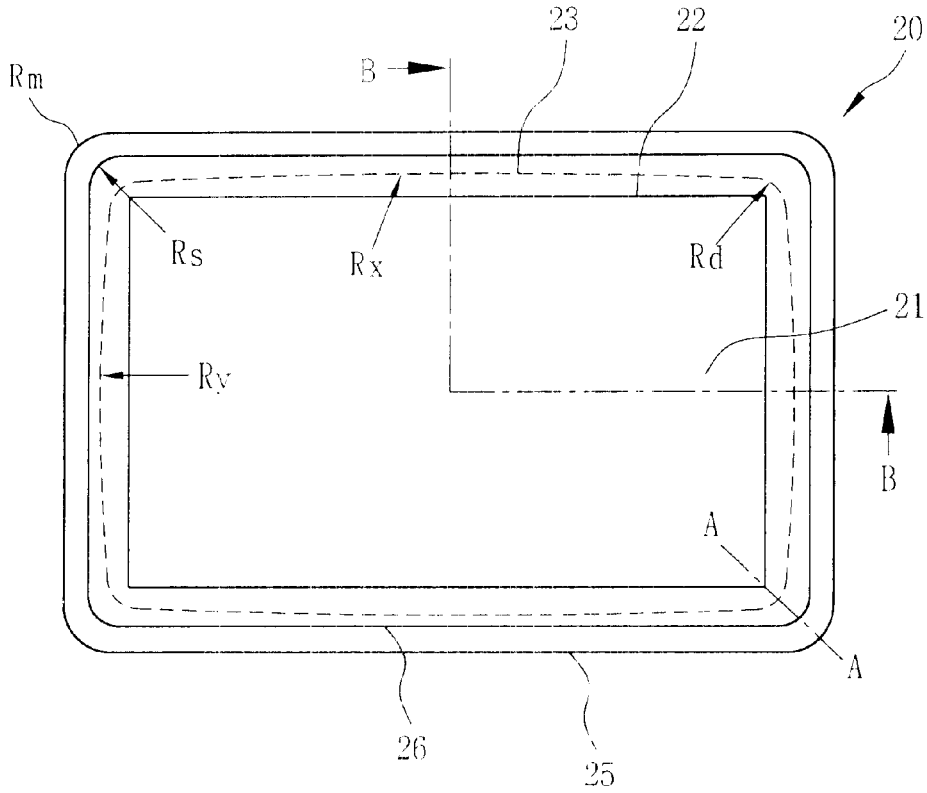
FIG. 2 is a rear elevation showing a panel for a flat screen CRT in accordance with the present invention.
Figure 3:
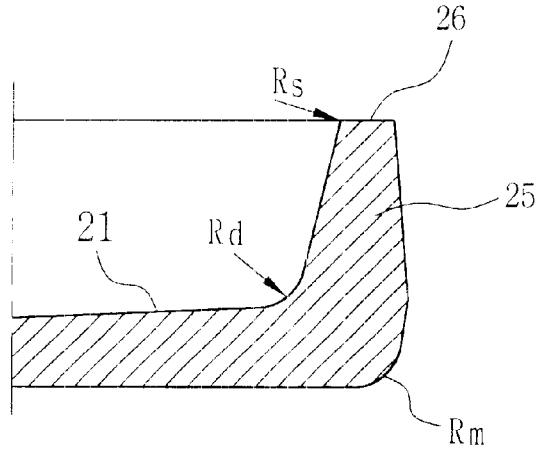
FIG. 3 is a sectional view taken along section line A—A in FIG. 2.

FIG. 2 is a rear elevation view showing a panel for a flat screen CRT in accordance with the present invention, and FIG. 3 is a partial sectional view taken along section line A—A in FIG. 2.

The panel for a flat screen type CRT 20 in accordance with the present invention includes a slightly concave internal curvature portion 21 within which a screen effective surface area 22 is formed, and a skirt portion 25 to which a funnel is connected by being extended rearwardly from the periphery of the internal curvature portion 21 for being joined to a funnel (not shown) of the CRT.

The screen effective surface area 22 is the inner portion of the rectangular area enclosed by a solid line in FIG. 2.

The panel 20 has a blend curvature portion 23 where the internal curvature portion 21 and skirt portion 25 meet.

The blend curvature portion 23 is divided into the radius of curvature Rx at a long side of the panel, the radius of curvature Ry at a short side of the panel and the radius of curvature Rd at the corner of the panel.

Also, the skirt portion 25 is formed having a radius of curvature Rs at the inner side of the corner of a seal edge portion 26 inside the corner of the seal edge portion and a radius of curvature Rm at an outer side of a corner of a mold match line.

Figure 4:
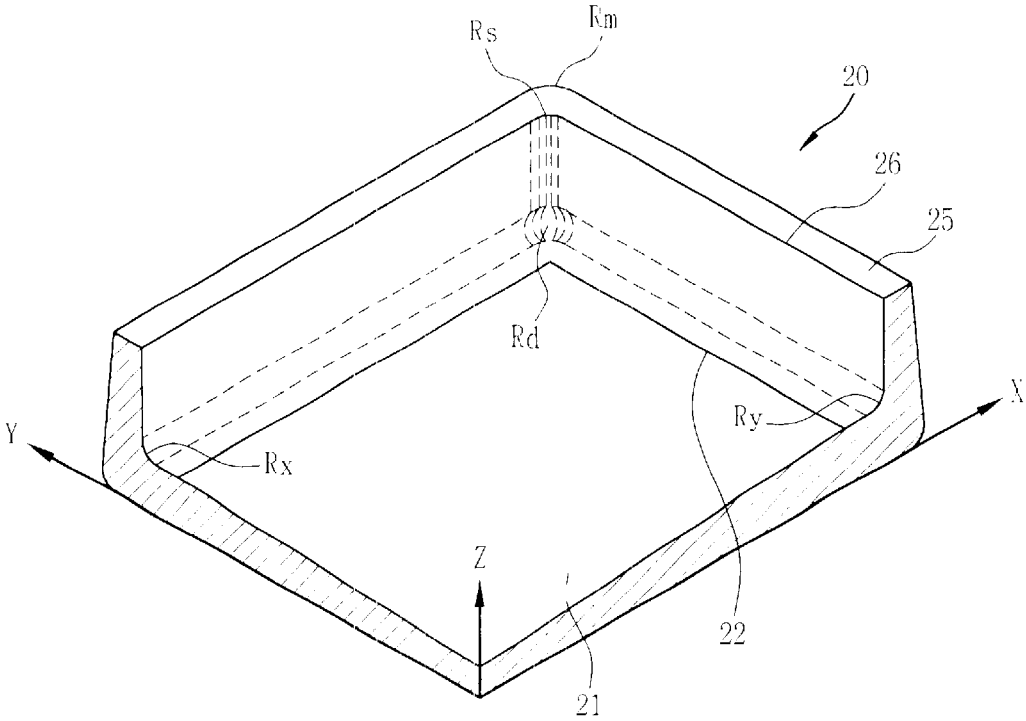
FIG. 4 is a perspective cutaway view taken along section line B—B in FIG. 2.

FIG. 4 is a perspective cutaway view taken along section line B—B in FIG. 2 wherein the radii of curvature of the respective blend radii Rx, Ry and Rd, the radius of curvature Rs at the inner side of the corner of the seal edge of the skirt and the radius of curvature Rm at the outer side of the corner of the mold match line are shown.

Here, the panel 20 is important to be designed having proper proportions of Rd/Rs, Rx/Rd, and Ry/Rd to reduce damage in the heating process in accordance with an increase in the size of the screen effective surface area 22, enhance the plasticity, and increase the salvage rate.

The relationship in the panel according to the present invention between the size of the screen effective surface area 22 and damage in the heating process during manufacture in accordance with the respective radii of blend curvature Rx, Ry, Rd where the internal curvature portion 21 and skirt portion 25 meet will now be described with reference to the experimental result graphs shown in FIGS. 5 through 9.

Figure 5:
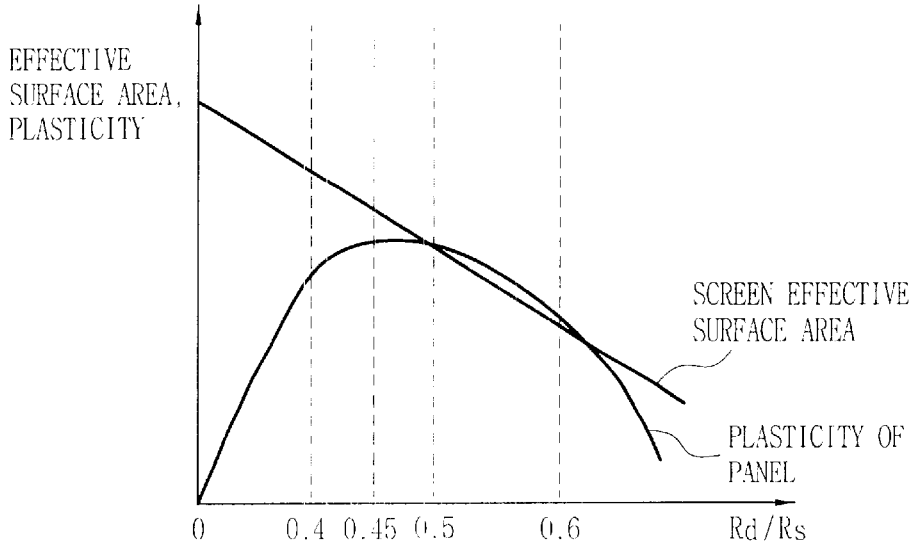
FIG. 5 is a graph showing a relationship between the size of a screen effective surface and plasticity according to the ratio Rd/Rs of the radius of curvature Rs of the skirt portion at the inner side of the corner to a radius of curvature of a corner blend in a panel for a flat screen CRT in accordance with the present invention.

FIG. 5 is a graph showing the relationship between the size and plasticity of the screen effective surface area 22 in accordance with the ratio of the radius of curvature at an inner side of a corner in the skirt portion 26 Rs to the radius of corner blend curvature Rd where the internal curvature portion 21 and skirt portion 25 meet in the panel.

As shown in FIG. 5, as the value of Rd/Rs increases, the size of the screen effective surface area 22 formed in the internal curvature portion 21 decreases and if the value is smaller than 0.4 or larger than 0.6, plasticity of the panel 20 falls.

Therefore, in the panel 20, if the value of Rd/Rs is set larger that 0.4 and smaller than 0.6, plasticity can be enhanced even when extending the size of the screen effective surface area 22.

Among the values, if the value of Rd/Rs is set larger than 0.45 and smaller than 0.50, plasticity of the panel 20 can be improved at the same time of having a desirably big size of the screen effective surface area 22.

At this time, the ratio Rm/Rs of the radius of curvature Rm at the outer side of the corner of the mold match line to the radius of curvature Rs at the inner side of the corner of the seal edge portion in the skirt portion is preferably smaller than 0.58 and larger than 0.54.

Namely, a reinforcing band is installed on the circumferential surface of is the skirt portion 25, so that a Cathode Ray Tube under the state of a high-degree vacuum can disperse stress, and accordingly, if the value of Rm/Rs is larger than 0.58, the internal curvature of the skirt portion 25 become smaller and the dispersing of stress through the reinforcing band can not performed properly. In addition, it is desirable that the value of Rm/Rs is set larger than 0.54 because if the value of Rm/Rs is too small, the thickness of the skirt portion 25 becomes too thick, and the weight of the panel 20 becomes too great.

Figure 6:
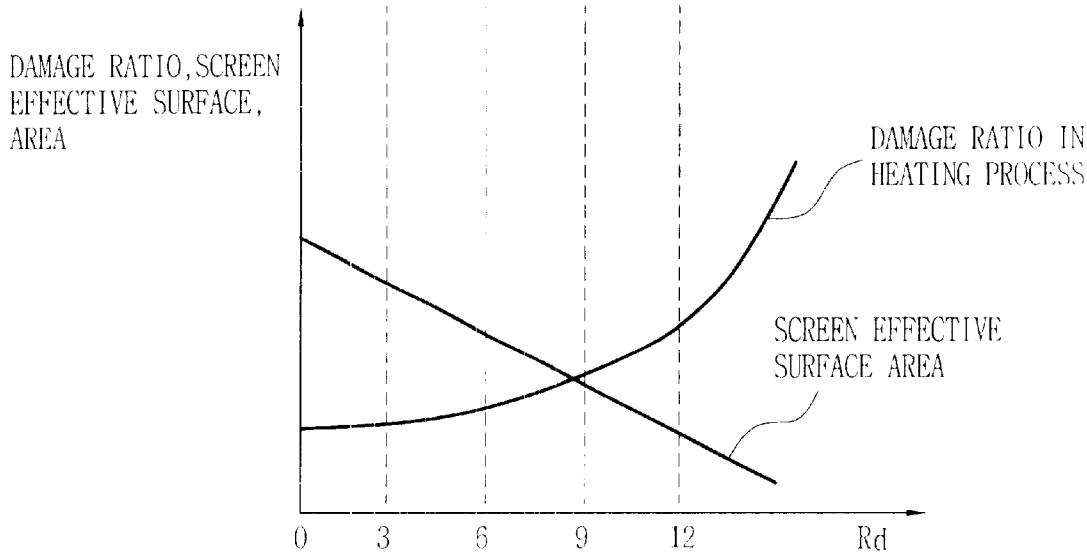
FIG. 6 is a graph showing the relationship between a change in the size of the screen effective surface according to the corner blend radius of curvature Rd and the change in the damage rate during a heating process in manufacturing.

FIG. 6 is a graph showing the change of the size of the effective surface area 22 and the damage ratio in the heating process in accordance with the change of the radius of corner blend curvature Rd of the panel 20.

As shown in FIG. 6, in case the radius of corner blend curvature Rd become larger, the size of the screen effective surface area 22 decreases relative to a CRT of the same size, and the thickness of the corner portion becomes larger relatively. Accordingly, the damage ratio in the heating process increases.

On the other hand, if the radius of corner blend curvature Rd decreases, the screen effective surface area 22 relative to a CRT of the same size increases and the thickness of the corner portion becomes smaller relatively. Accordingly, the damage ratio in the heating process and weight decrease.

Therefore, it is desirable that the radius of corner blend curvature Rd where the screen effective surface area 22 and skirt portion 25 meet in the panel is set larger than 3 mm and smaller than 6 mm.

Here, in case the radius of corner blend curvature Rd decreases to smaller than 3 mm, the plasticity of the panel 20 is deteriorated and there arises a possibility of centralizing stress in a certain portion.

Figure 7:
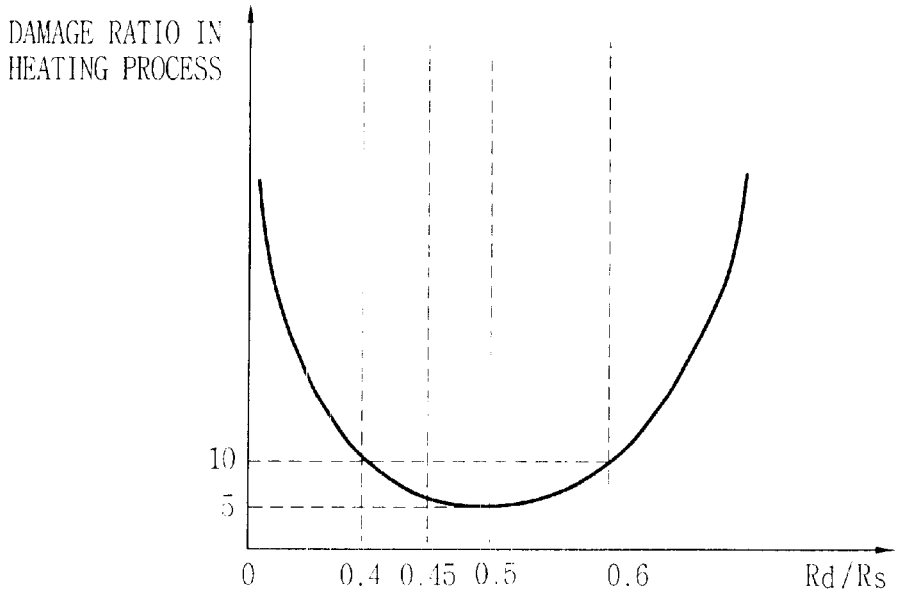
FIG. 7 is a graph showing the change in the damage rate during a heating process in manufacturing according to the ratio Rd/Rs of the radius of curvature Rd a corner blend to the radius Rs of curvature of at the inner side of the corner of the skirt portion in a panel for a flat screen CRT in accordance with the present invention.
Figure 8:
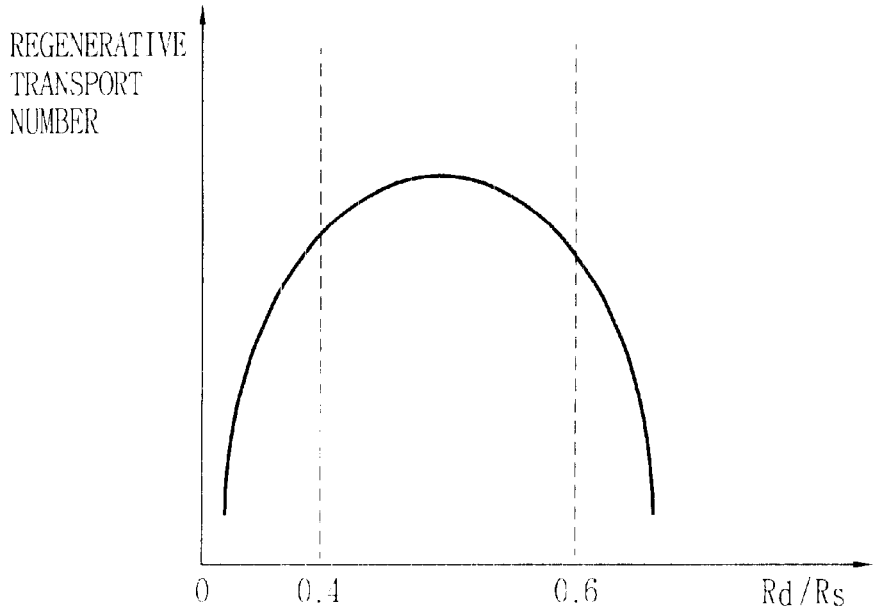
FIG. 8 is a graph showing a change in a salvage rate according to the ratio of the radius of curvature at the inner side of the corner of the skirt portion to the a radius of curvature of a corner blend.

FIGS. 7 and 8 are graphs showing the relationship between the occurrence of damage in the heating process and the salvage rate in accordance with the ratio Rd/Rs of the radius of curvature Rs radius curvature Rd of corner blend where the screen effective surface area 22 and skirt portion 25 meet to the at the inner side of corner of a seal edge portion inside the corner of the seal edge portion 26.

As shown in FIGS. 7 and 8, in case the value of Rd/Rs is smaller than 0.4 or larger than 0.6, the damage ratio increases to more than 10% and at the same time, the salvage rate also decreases substantially.

Therefore, the panel 20 in accordance with the present invention is able to reduce the damage ratio in the heating process in accordance with setting the value of Rd/Rs between 0.4 and 0.6 so as to increase the salvage rate, and particularly, if the value of Rd/Rs is set between 0.45~0.5, the damage ratio in the heating process can be decreased to lower than 5% while increasing the salvage rate.

The reason that reduction of the damage ratio in the heating process is possible in case the value of Rd/Rs is set in the range of 0.4 to 0.6 is that the panel thereby becomes more resistant to damage in the heating process, the pressure of the reinforcing band can be dispersed particularly in case of attaching the reinforcing band around the skirt portion 25, and accordingly, a sufficient impact resistant performance can be enhanced.

However, if the value of Rd/Rs is too large, there is a disadvantage of increasing the required size of the outer wall of the panel 20.

Figure 9:
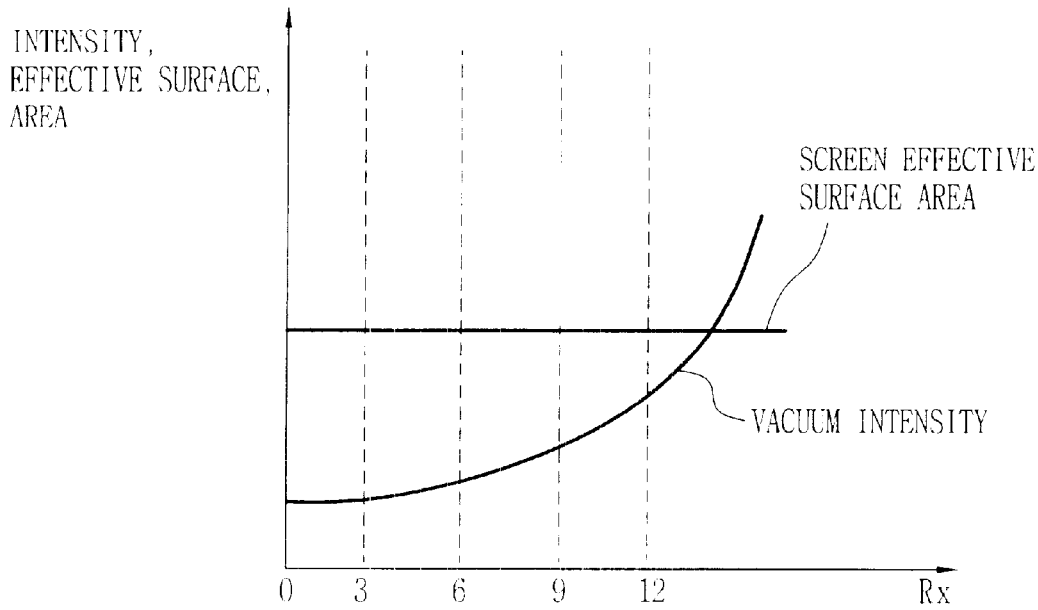
FIG. 9 is a graph showing a change of the radius of curvature of a long-side brand, vacuum intensity, and a size of screen effective surface in a panel for a flat screen CRT in accordance with the present invention.

FIG. 9 is a graph showing the relationship between the radius of curvature Rx of the long-side blend where the internal curvature portion and skirt portion meet, the degree of vacuum, and the size of the effective surface area.

Even though the radius of curvature Rx of the long-side blend of the panel 20 is set larger to an extent, the size of the screen effective surface area 22.

Conventionally, because a panel is weakest in the portion of the long-side of the panel under a vacuum condition, the weakness is compensated by increasing the side surface in case of setting the radius of curvature Rx of the long-side blend larger.

Generally, the portion where the radius of corner blend curvature Rd is formed is formed to have a curvature 1.5 times as much as that of the radius Rx of long-side blend curvature, and even though Rx increases, there is no effect on the damage ratio because the thickness of the panel is not thicker than that at the diagonal corner blend radius Rd.

Therefore, it is desirable that the radius of curvature Rx of the long-side blend where the internal curvature portion and skirt portion meet is set larger than 6 mm and less than 12 mm.

At this time, the radius of curvature Rx of the long-side blend and the radius of curvature Rd of corner blend should be set satisfying the relation of $1 \leqq Rx/Rd \leqq 4$ m and among the values in the range, in case the value of Rd/Rs is set as $1 \leqq Rx/Rd \leqq 2$, the degree of vacuum which the panel 20 can withstand can be increased in accordance with having a desirably big size of the screen effective surface area 22.

On the other hand, it is desirable that the radius of curvature Ry of the short-side blend according to the present invention is determined on the level that the Ry is smoothly connected to Rd when the plasticity of the panel 20 is good as the blend radius Ry does not affect on ordinary tension stress, screen effective surface and heating process.

Reducing the radius of curvature Ry of the short-side blend is good for reducing the weight of the panel.

Therefore, it is desirable that the radius Rx of long-side blend curvature and the radius of curvature Ry of the short-side blend are designed satisfying the relations of $Rd \leqq Ry < Rx$ or $Ry = Rx$.

As will be apparent from the above description, by setting the ratios of the radius of curvature at an inner side of a corner of a seal edge portion in a skirt portion to the radius of corner blend curvature where the internal curvature portion and skirt portion meet, and of the radius of blend curvature of a long-side of the panel, radius of blend curvature of a short-side of the panel and radius of blend curvature of the corner of the panel Rd, the size of the screen effective surface area can be increased compared to that of a CRT with a same size in accordance with having a desirably big size of the screen effective surface area.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are intended to be embraced by the appended claims.

What is claimed is:

1. A panel for a flat screen type CRT, comprising:

an internal curvature portion whereat a screen effective surface is formed, and a skirt portion rearwardly extended from an edge of the internal curvature portion for being coupled to a funnel, satisfying the relations $0.4 < Rd/Rs < 0.6$, $1 \leqq Rx/Rd \leqq 4$, and $1 \leqq Ry/Rd \leqq 2$, where Rs represents a radius of curvature at an inner side of a corner of a seal edge portion in the skirt portion, and Rx, Ry, and Rd are respectively radii of blend curvature of a long-side portion, a short-side portion and a corner portion where the internal curvature portion and the skirt portion meet.

2. A panel for a flat screen type CRT comprising:

an internal curvature portion whereat a screen effective surface area is formed, and a skirt portion rearwardly extended from an edge of the internal curvature portion for being coupled to a funnel, satisfying the relation $0.4 < Rd/Rs < 0.6$, where Rd is a radius of curvature of a corner blend where the internal curvature portion and the skirt portion meet, and Rs is a radius of curvature at an inner side of the corner of a seal edge portion of the skirt portion.

3. The panel for a flat screen type CRT of claim 2, wherein the relation $0.45 < Rd/Rs < 0.50$ is satisfied.

4. The panel for a flat type CRT according to claim 2, wherein the relation $Rm/Rs \leqq 0.58$ is satisfied, where Rm is a radius of curvature at an outer side of a corner of a mold match line in the skirt portion.

5. The panel for a flat screen type CRT of claim 4, wherein the relation $0.54 \leqq Rm/Rs \leqq 0.58$ is satisfied.

6. The panel for a flat screen type CRT of claim 2, wherein the relation of 3 mm $\leqq Rd \leqq$ 6 mm is satisfied.

7. A panel for a flat screen type CRT comprising:

an internal curvature portion whereat a screen effective surface is formed, and a skirt portion extended rearwardly from an edge of the internal curvature portion for being coupled to a funnel, wherein the relations $1 \leqq Rx/Rd \leqq 4$, and $1 \leqq Ry/Rd \leqq 2$ are satisfied, where Rx, Ry and Rd are respectively radii of blend curvature of a long-side portion, a short-side portion and a corner portion where the internal curvature portion and the skirt portion meet.

8. The panel for a flat screen type CRT of claim 7, wherein the relation $Rd \leqq Ry < Rx$ is satisfied.

9. The panel for a flat screen type CRT of claim 7, wherein the equation $Ry = Rx$ is satisfied.

10. The panel for a flat screen type CRT of claim 7, wherein the relation 6 mm $\leqq Rx \leqq$ 12 mm is satisfied.

11. The panel for a flat screen type CRT of claim 7, wherein the relation 3 mm $\leqq Rd \leqq$ 6 mm is satisfied.

* * * * *